US012759754B2

(12) United States Patent
Wadsworth et al.

(10) Patent No.: US 12,759,754 B2
(45) Date of Patent: Oct. 13, 2026

(54) USER-ASSEMBLED DISPENSER

(71) Applicant: MARS, INCORPORATED, McLean, VA (US)

(72) Inventors: Luke Wadsworth, North Yorkshire (GB); Thomas Frith, Middlesex (GB); Benjamin Sillence, London (GB); Wiesje Heijmans, Tilburg (NL)

(73) Assignee: Mars, Incorporated, McLean, VA (US)

( * ) Notice: Subject to any disclaimer, the term of this patent is extended or adjusted under 35 U.S.C. 154(b) by 354 days.

(21) Appl. No.: 17/789,364

(22) PCT Filed: Jan. 13, 2021

(86) PCT No.: PCT/US2021/013155
§ 371 (c)(1),
(2) Date: Jun. 27, 2022

(87) PCT Pub. No.: WO2021/150403
PCT Pub. Date: Jul. 29, 2021

(65) Prior Publication Data

US 2023/0039448 A1 Feb. 9, 2023

(30) Foreign Application Priority Data

Jan. 24, 2020 (GB) ..... 2001064

(51) Int. Cl.
*B65D 5/76* (2006.01)
*B65D 5/32* (2006.01)
*B65D 5/72* (2006.01)

(52) U.S. Cl.
CPC ..... *B65D 5/76* (2013.01); *B65D 5/321* (2013.01); *B65D 5/326* (2013.01); *B65D 5/721* (2013.01)

(58) Field of Classification Search
CPC ..... B31B 2120/60; B65D 5/38; B65D 5/76; B65D 5/321; B65D 5/326; B65D 5/721;
(Continued)

(56) References Cited

U.S. PATENT DOCUMENTS 83,106 A 10/1868 Taylor
1,450,279 A 4/1923 Chick
(Continued)

FOREIGN PATENT DOCUMENTS

CA 74355 S 6/1994
CA 2613841 A1 12/2008
(Continued)

*Primary Examiner* — Gene O Crawford
*Assistant Examiner* — Kelvin L Randall, Jr.
(74) *Attorney, Agent, or Firm* — Bookoff McAndrews, PLLC

(57) ABSTRACT

A product dispenser formed from a plurality of blanks of sheet material. The product dispenser includes a storage portion and a base dispenser portion each formed from at least one folded blank of sheet material. The storage portion includes an interior configured to hold a quantity of products therein. The base dispenser portion is coupled to the storage portion, and the base dispenser portion includes a receptacle in selective communication with the interior. An actuating mechanism is configured to translate the storage portion relative to the base dispenser portion. The products are restricted from being dispensed to the receptacle when the storage portion is in a first operating position, and the products are dispensable to the receptacle when the storage portion is in a second operating position.

20 Claims, 8 Drawing Sheets

(58) Field of Classification Search
CPC ..... B65D 5/723; B65D 5/726; B65D 5/728; B65D 5/4266; B65D 5/6688
See application file for complete search history.

(56) References Cited

U.S. PATENT DOCUMENTS

| | | | | | |
|---|---|---|---|---|---|
| 1,629,976 | A * | 5/1927 | Smith, Jr. | A44C 5/08 | 59/79.3 |
| D77,717 | S | 2/1929 | Warrin | | |
| 1,889,232 | A * | 11/1932 | Ware | B65D 85/1009 | 221/302 |
| 2,354,741 | A * | 8/1944 | Crane | B65D 83/0481 | 229/122 |
| 2,359,337 | A * | 10/1944 | Turek | A47F 1/085 | 221/92 |
| 2,475,738 | A * | 7/1949 | Epplin | B65D 83/0409 | 221/197 |
| 3,071,306 | A * | 1/1963 | Trethewey | B65D 5/728 | 229/122 |
| 3,392,878 | A * | 7/1968 | Jackson | A47F 1/08 | 221/307 |
| D236,407 | S | 8/1975 | Saipe | | |
| D264,594 | S | 5/1982 | Lyons | | |
| D298,520 | S | 11/1988 | Pickering | | |
| 4,913,312 | A * | 4/1990 | Boutin | A47K 10/422 | 248/905 |
| 5,174,471 | A * | 12/1992 | Kozlowski | B65D 83/0409 | 221/202 |
| D347,364 | S | 5/1994 | Guido et al. | | |
| 5,425,499 | A * | 6/1995 | Pfieffer | B65D 5/326 | 229/115 |
| 5,458,272 | A | 10/1995 | Ward-weber | | |
| D375,679 | S | 11/1996 | Russell | | |
| D380,353 | S | 7/1997 | Cohen et al. | | |
| D438,112 | S | 2/2001 | Keung | | |
| 6,578,732 | B1 * | 6/2003 | Mabry | A47F 1/04 | 221/60 |
| 7,073,685 | B1 * | 7/2006 | Giraud | B65D 83/0409 | 221/64 |
| 7,481,313 | B1 * | 1/2009 | Kramedjian | B65D 5/4225 | 206/427 |
| D607,340 | S | 1/2010 | Klis | | |
| D612,289 | S | 3/2010 | Donovan | | |
| 7,703,665 | B2 * | 4/2010 | McGowan | B65D 5/721 | 221/302 |
| D690,549 | S | 10/2013 | Porraro | | |
| D695,064 | S | 12/2013 | Seymour et al. | | |
| D702,087 | S | 4/2014 | Steel et al. | | |
| D702,474 | S | 4/2014 | Scherer et al. | | |
| D702,503 | S | 4/2014 | Steel et al. | | |
| D779,888 | S | 2/2017 | Baker | | |
| D785,408 | S | 5/2017 | Muller et al. | | |
| D811,804 | S | 3/2018 | Smith | | |
| D812,963 | S | 3/2018 | Smith | | |
| D857,461 | S | 8/2019 | Korsmit | | |
| D880,308 | S | 4/2020 | Reiss et al. | | |
| D880,309 | S | 4/2020 | Reiss et al. | | |
| D886,357 | S | 6/2020 | Gambrel et al. | | |
| D896,038 | S | 9/2020 | Gadd et al. | | |
| D913,043 | S | 3/2021 | Miley | | |
| 11,738,918 | B2 * | 8/2023 | Levitz | B65D 5/20 | 206/1.5 |
| 2003/0094461 | A1 * | 5/2003 | Knol | B65D 5/0236 | 221/305 |
| 2003/0226879 | A1 | 12/2003 | Auclair et al. | | |
| 2004/0051008 | A1 * | 3/2004 | Tominello | B65D 5/5206 | 248/146 |
| 2008/0116217 | A1 * | 5/2008 | Klein | A47K 10/421 | 221/45 |
| 2009/0145953 | A1 | 6/2009 | Heinemann III et al. | | |
| 2011/0127289 | A1 * | 6/2011 | Workman | B65D 5/38 | 221/282 |
| 2011/0155624 | A1 * | 6/2011 | Caron | B65D 43/20 | 206/531 |
| 2012/0294663 | A1 | 11/2012 | Papavero et al. | | |
| 2014/0158578 | A1 | 6/2014 | Varan | | |
| 2017/0305609 | A1 | 10/2017 | Mcguire et al. | | |
| 2018/0022503 | A1 | 1/2018 | Waddington | | |
| 2018/0105348 | A1 * | 4/2018 | Modha | B65D 5/724 | |

FOREIGN PATENT DOCUMENTS

| | | | | |
|---|---|---|---|---|
| CA | 2740184 | A1 | 11/2011 | |
| CN | 201512191 | U | 6/2010 | |
| CN | 101983160 | A | 3/2011 | |
| CN | 102186731 | A | 9/2011 | |
| CN | 107848660 | A | 3/2018 | |
| DE | 10352206 | A1 | 6/2005 | |
| EP | 2481676 | A1 * | 8/2012 | B65D 5/728 |
| WO | 2014105662 | A1 | 7/2014 | |

* cited by examiner

USER-ASSEMBLED DISPENSER

BACKGROUND

The field of the present disclosure relates generally to product dispensers and, more specifically, to a user-assembled (i.e. build-your-own) product dispenser formed from multiple blanks of sheet material.

At least some known products are in the form of small objects, such as candies, pills, tablets, and the like. The products may be provided to a consumer in a limited quantity at a point of sale, or in a bulk quantity to be consumed over time. Many known product dispensers are available that facilitate providing the bulk quantity of products to the consumer over time. For example, a product dispenser may be designed to hold a quantity of products in a storage compartment, and to control dispensation of the products to the consumer from the storage compartment. Accordingly, a consumer may purchase the bulk quantity of products and a product dispenser and may fill the storage compartment with additional quantities of products as-needed. Product dispensers available to the consumer are typically pre-assembled from metallic and/or thermoplastic material and are ready for use at the time of purchase.

BRIEF DESCRIPTION

In one aspect, a product dispenser formed from a plurality of blanks of sheet material is provided. The product dispenser includes a storage portion and a base dispenser portion each formed from at least one folded blank of sheet material. The storage portion includes an interior configured to hold a quantity of products therein. The base dispenser portion is coupled to the storage portion, and the base dispenser portion includes a receptacle in selective communication with the interior. An actuating mechanism is configured to translate the storage portion relative to the base dispenser portion. The products are restricted from being dispensed to the receptacle when the storage portion is in a first operating position, and the products are dispensable to the receptacle when the storage portion is in a second operating position.

In one example, the folded blanks of sheet material are fabricated from a paperboard or cardboard material.

In one example, the folded blanks of sheet material are fabricated from a recyclable material.

In one example, the product dispenser further includes a cover portion formed from at least one blank of sheet material, the cover portion removably coupled to the storage portion for providing access to the interior.

In one example, the product dispenser further includes a pin base portion formed from at least one folded blank of sheet material, wherein the pin base portion is coupled to the storage portion and is in a fixed position relative to the base dispenser portion.

In one example, the actuating mechanism is coupled to the base dispenser portion and the pin base portion.

In another aspect, a kit for forming a product dispenser for dispensing products is provided. The kit includes at least one blank of sheet material for forming a storage portion of the product dispenser, wherein the at least one blank is foldable for forming an interior configured to hold a quantity of products therein. The kit also includes at least one blank of sheet material for forming a base dispenser portion of the product dispenser, wherein the at least one blank is foldable for forming a receptacle in selective communication with the interior. The base dispenser portion is configured to couple to the storage portion. An actuating mechanism is configured to translate the storage portion relative to the base dispenser portion.

In one example, the kit further includes at least one blank of sheet material for forming a pin base portion of the product dispenser, the pin base portion configured to couple to the storage portion.

In one example, the actuating mechanism includes a plurality of pins including a first pin configured for coupling to the at least one blank of the base dispenser portion, and a second pin configured for coupling to the at least one blank of the pin base portion, and an elastic member configured to couple between the first pin and the second pin.

In one example, at least one of the blanks of sheet material for forming the storage portion, the base dispenser portion, or the pin base portion has a graphic printed thereon or included on a label applied thereto.

In one example, the blanks of sheet material for forming the storage portion and the base dispenser portion are packaged in a flat state.

In one example, the kit further includes an instruction manual for assembling the product dispenser.

DETAILED DESCRIPTION

Figure 1:
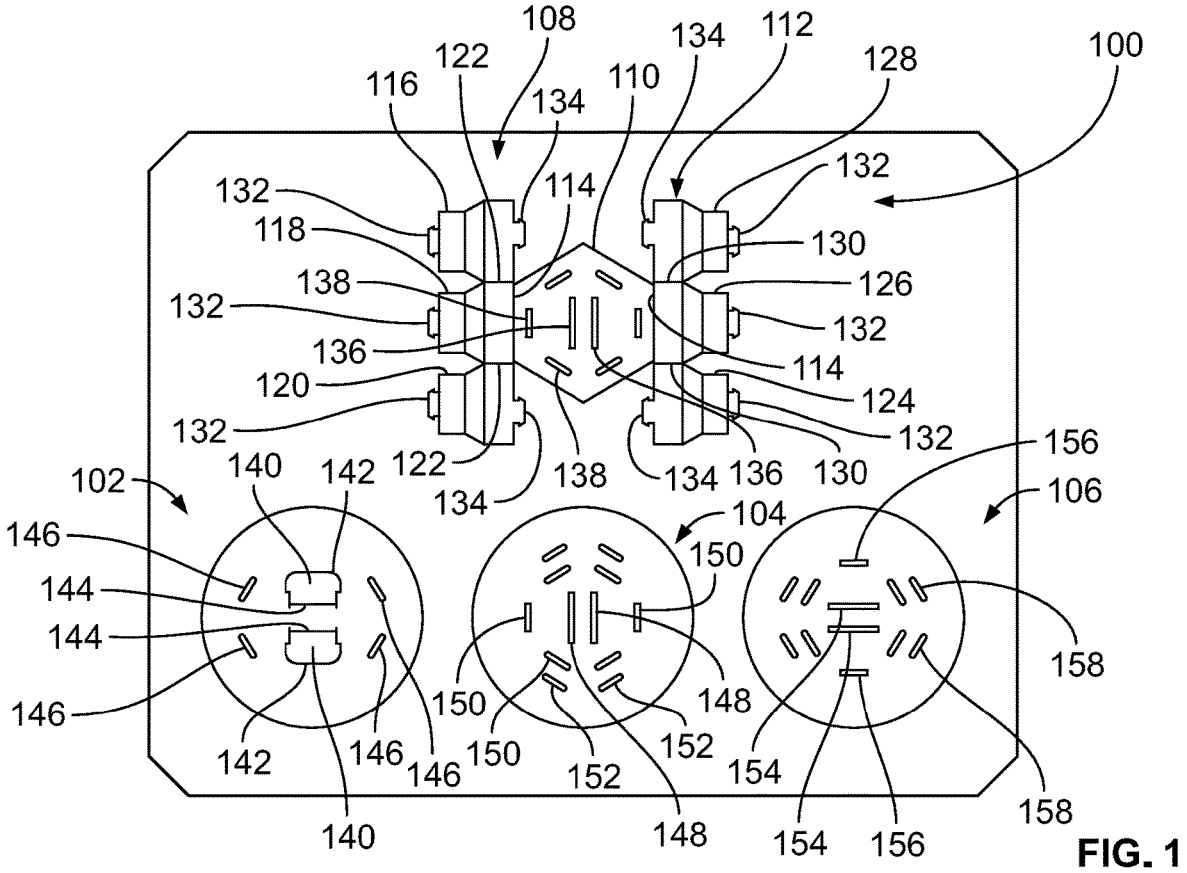
FIG. 1 illustrates first, second, third, and fourth blanks of sheet material for forming an example product dispenser.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

Embodiments of the present disclosure relate to a user-assembled or build-your-own product dispenser formed from multiple blanks of sheet material. The blanks of sheet material may be provided to a consumer in a flat and unassembled state, which enables a package containing the blanks to be retailed at a point of sale or delivered to the consumer in a space-saving, cost-effective, and efficient manner Instructions may be provided in the package for guiding the consumer in assembling the product dispenser from the blanks. For example, the instructions may include step-by-step graphical and/or written instructions for guiding the consumer in assembling the product dispenser. The instructions are easily understandable to adults and children of many ages. Accordingly, assembly of the product dispenser may be an interactive and fun individual or group activity.

In one example embodiment, when assembled, the product dispenser includes a storage portion, a base dispenser portion, and an actuation mechanism that facilitates providing products from the storage portion to the base dispenser portion. For example, the storage portion is sized to hold a quantity of products therein and is translatable relative to the base dispenser portion between a first operating position and a second operating position. When in the first operating position, dispensation of the products from the storage portion is restricted. The actuation mechanism facilitates holding the storage portion in the first operating position (i.e., a neutral position) until a biasing force is provided to the storage portion. The biasing force facilitates translating the storage portion from the first operating position to the second operating position, in which dispensation of the products from the storage portion is enabled. In one example only a portion of products in the dispenser is dispensed. By limiting the amount of product dispensed it could help a user with their health goals. In other example, the entire amount of stored products in the dispenser is dispensed. In one example, products dispensed from the storage portion are received and contained within a receptacle of the base dispenser portion, which is accessible by the consumer. (In an alternative embodiment, products dispensed from the storage portion may be directly received by a consumer.) When the biasing force is removed, the actuation mechanism facilitates translating the storage portion from the second operating position to the first operating position, and the dispensation of products is once again restricted. In an example embodiment a cover portion is removably coupled to the storage portion to enable the storage portion to be refilled with products. In that way the dispenser may be refilled from a bulk product dispenser and packaging resources will be saved.

As noted above, the product dispenser may be formed from folded blanks of sheet material, such as a paperboard material. The product dispenser, however, may be fabricated using any suitable material or combination of materials, and therefore is not limited to a specific type of material. In alternative embodiments, the product dispenser may be fabricated using cardboard, plastic, metal, and/or any suitable material (or combination of materials) known to those skilled in the art and guided by the teachings herein provided. In one embodiment the material is food safe so that the dispenser can safely store and dispense food items. In one embodiment the dispenser is made with recyclable materials. As described below, one or more blanks of the sheet material may be provided with a decorative design on at least one surface thereof.

Any product may be used with the product dispenser. In one example, the product may be a food such as a chocolate, candy, confectionery, gum, mint, dried fruit, pet food, pet treats, spices, grains, or snack food item. In another example, any product may be used with the product dispenser such as any consumer good (batteries, disposable earplugs, soap, medicine, etc.).

In one example, the user-assembled product dispenser may be decorated with graphics, textures, embossing and debossing, and the like. In one example, the dispenser is highly customizable, for example, by using digital printing and the like to have customized graphics on the dispenser. In one example, one or more blanks will be printed with a picture, text, or design (e.g. a user's name, a special message, or a company logo). In another example the blank may be unadorned, and a user may be instructed to decorate or design their dispenser. In one example, there may be a code on the dispenser. A code may be a marker that corresponds to another piece of information or a location of information and may be presented in the form of a quick-read (QR) code, a bar code, an alphanumeric code, wireless tags (e.g., NFC, RFID, etc.) and so on. The code may be read by a computing device (e.g., a mobile device such as a smartphone or tablet, a laptop with a scanning apparatus, and so on) or otherwise entered into a computing system to access corresponding information such as websites, videos, images, marketing information, product information, computing device applications (e.g., loyalty program apps, games, tools, augmented reality programs, etc.), and so on that may correspond to the product, its manufacturer, one or more graphics on the dispenser, and so on. For example, a consumer may obtain an embodiment of the dispenser with the code embodied as a QR code configured to retrieve a website with a game relating to the product to be dispensed. A consumer may use a smartphone with a QR code reader to scan the code, which causes the smartphone to open a web browser displaying the website, allowing the consumer to play a game. In another example, the consumer may use a smartphone with a QR code reader to scan the code, which causes the smartphone to display a personalized message.

Referring now to the drawings, FIG. 1 illustrates a first blank 100, a second blank 102, a third blank 104, and a fourth blank 106 of sheet material for forming an example product dispenser. In one example, first blank 100 includes a first flap assembly 108, a central portion 110, and a second flap assembly 112 coupled together along preformed, generally parallel fold lines 114. First flap assembly 108 includes a first foldable flap 116, a second foldable flap 118, and a third foldable flap 120 coupled together along preformed, generally parallel fold lines 122. Second flap assembly 112 includes a fourth foldable flap 124, a fifth foldable flap 126, and a sixth foldable flap 128 coupled together along preformed, generally parallel fold lines 130. Each foldable flap 116, 118, 120, 124, 126, and 128 includes a first tab 132 extending from a first side thereof. In addition, foldable flaps 116, 120, 124, and 128 each include a second tab 134 extending from an opposing second side thereof. In one example, central portion 110 has a generally polygonal shape and includes a pair of generally parallel central slots 136 defined therein. A plurality of peripheral tab slots 138 are also defined central portion 110 and are arranged about central slots 136.

In one example, second blank 102 has a generally circular shape and includes a pair of central joining tabs 140 defined therein. Central joining tabs 140 are defined by a cut line 142 and are foldable out of plane with a remainder of second blank 102 about a fold line 144. Second blank 102 also includes a plurality peripheral tab slots 146 defined about central joining tabs 140.

In one example, third blank 104 has a generally circular shape and includes a pair of generally parallel central slots 148, a plurality of inner radial peripheral tab slots 150 defined about central slots 148, and a plurality of outer radial tab slots 152 defined about inner radial tab slots 150.

In one example, fourth blank 106 has a generally circular shape and includes a pair of generally parallel central slots 154, a plurality of inner radial peripheral tab slots 156 defined about central slots 154, and a plurality of outer radial tab slots 158 defined about inner radial tab slots 156.

Figure 2:
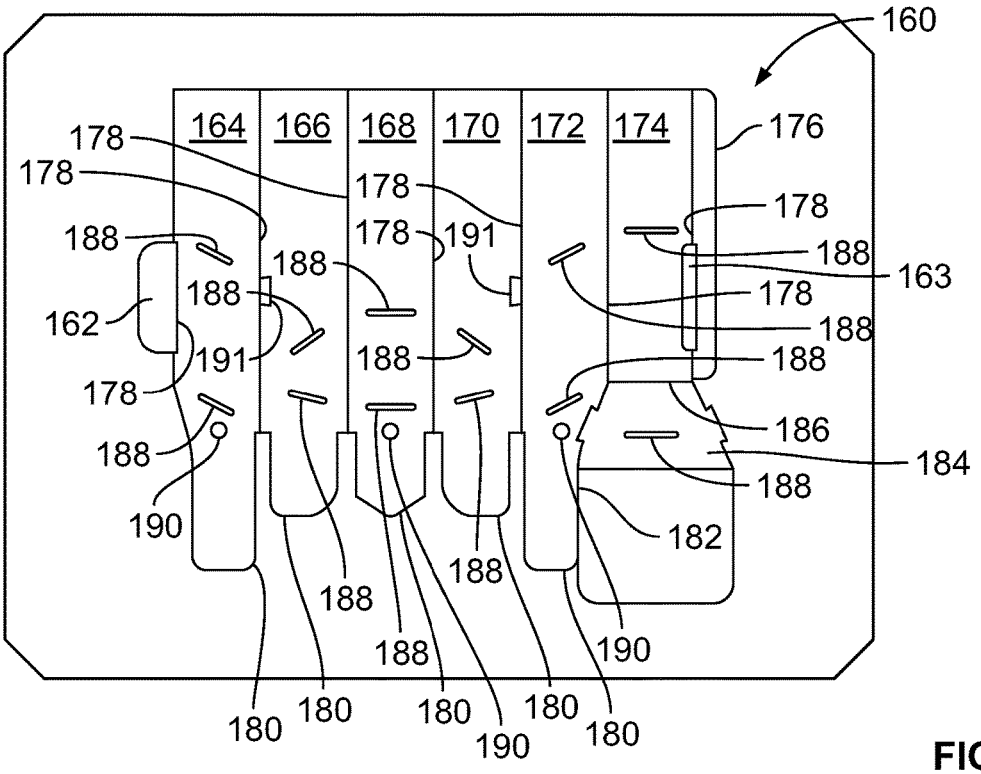
FIG. 2 illustrates a fifth blank of sheet material for forming the example product dispenser.

FIG. 2 illustrates a fifth blank 160 of sheet material for forming the example product dispenser. In one example, fifth blank 160 includes a first joining tab 162, a first side panel 164, a second side panel 166, a third side panel 168, a fourth side panel 170, a fifth side panel 172, a sixth side panel 174, and a second joining tab 176 coupled together along preformed, generally parallel fold lines 178. In one example, there is a tab slot 163 between sixth side panel 174 and second joining tab 176 that is configured to receive first joining tab 162. Side panels 164, 166, 168, 170, and 172 each have a bottom edge and a bottom flap 180 extending from the bottom edge. A cut line 182, extending is defined between fifth side panel 172 and sixth side panel 174. A blocking flap 184 is coupled to sixth side panel 174 along fold line 186.

Side panels 164, 166, 168, 170, 172, and 174 each also include one or more tab slots 188 defined therein. In addition, first side panel 164, third side panel 168, and fifth side panel 172 each include a pin opening 190 defined therein. In one example, side panels 166 and 170 each include a tab opening 191 defined therein. In addition, in one example, at least some of tab slots 188 are oriented obliquely relative to fold lines 178. Accordingly, the oblique tab slots 188 are oriented to facilitate coupling of ramps within a storage portion of the product dispenser, wherein the ramps are configured to channel products contained within the storage portion through the interior of the storage portion to be dispensed from the product dispenser.

Figure 3:
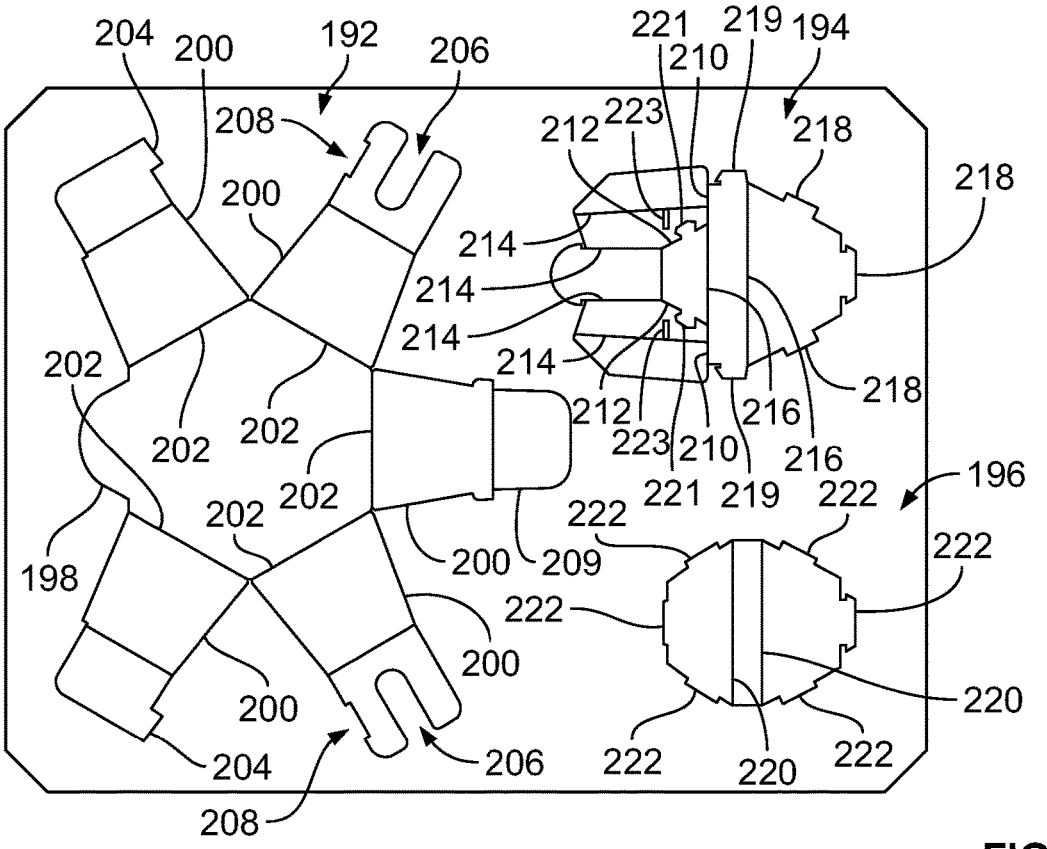
FIG. 3 illustrates sixth, seventh, and eighth blanks of sheet material for forming the example product dispenser.
Figure 10:
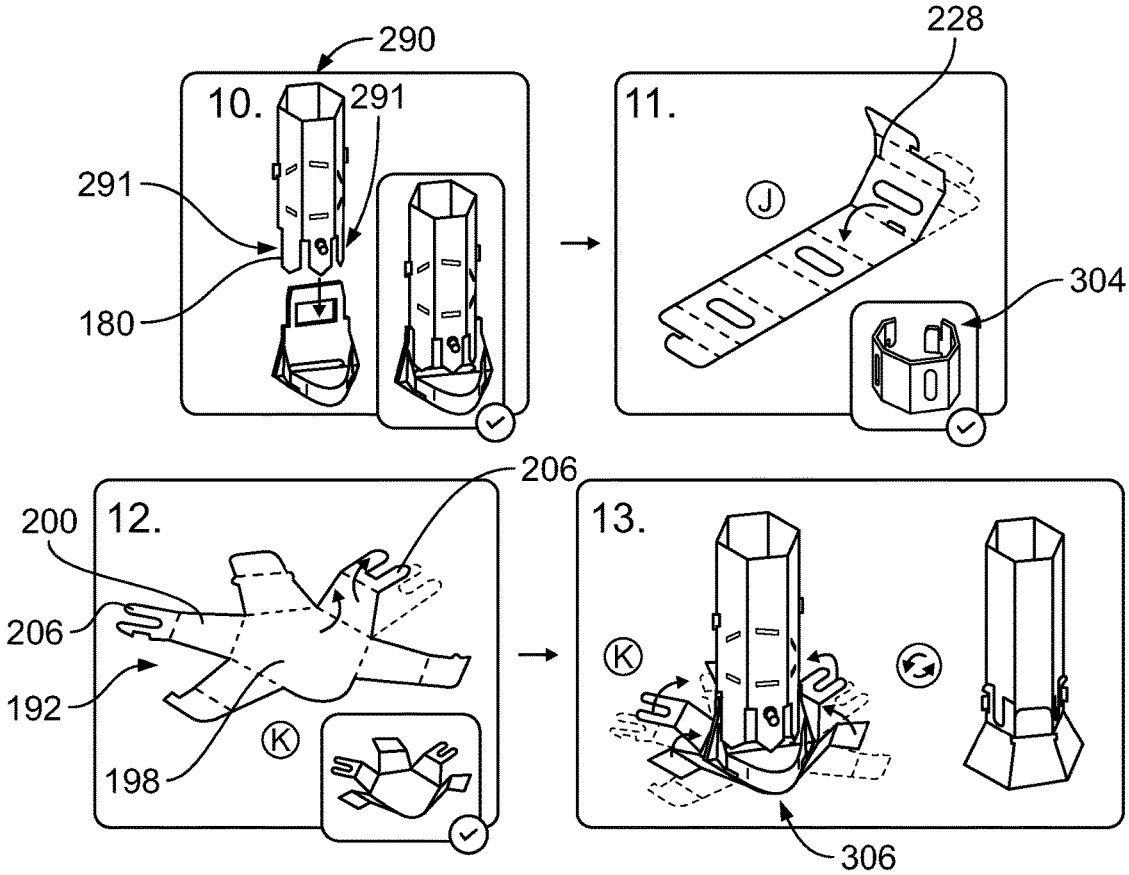
FIG. 10 illustrates a first series of process steps for assembling the example product dispenser from the parts shown in FIGS. 8 and 9, and from the sixth and eleventh blanks of sheet material shown in FIGS. 3 and 4.

FIG. 3 illustrates a sixth blank 192, a seventh blank 194, and an eighth blank 196 of sheet material for forming the example product dispenser. In one example, sixth blank 192 includes a central portion 198, and a plurality of side flaps 200 extending from central portion 198 along respective fold lines 202. Distal portions of at least two side flaps 200 include a tab 204 on one side thereof. Distal portions of at least two side flaps 200 include a central slot 206 defined therein, and a notch 208 defined on one side thereof. The distal portion of at least one side flap 200 defines a rear flap 209. In one example, each of the distal portions are configured to be encapsulated by a circumferential strap when coupling a storage portion and a base dispenser portion of the product dispenser to each other. Encapsulating the distal portions by the circumferential strap facilitates securing side flaps 200 against the storage portion. Central slot 206 may be configured to enable pins to extend therethrough when assembling a base dispenser portion, as illustrated in FIG. 10.

In one example, seventh blank 194 includes first cut lines 210 and second cut lines 212 defined therein, which extend to the intersection of adjacent fold lines. For example, seventh blank 194 is also defined by a plurality of longitudinal fold lines 214 and a plurality of lateral fold lines 216. A plurality of tabs 218 are also defined along the periphery of seventh blank 194. Cut line 212 defines a pair of tab cutouts 213. In one example, seventh blank 194 also includes a pair of side tabs 219, and a pair of tab cutouts 221 defined by cut line 212, and tab cutout slots 223.

In one example, eighth blank 196 is defined by a pair of lateral fold lines 220 and includes a plurality of tabs 222 defined along its periphery. In one example there are six tabs 222 around eighth blank 196. The tabs may be a similar shape or they may be different. The tabs 222 may be configured to engage tab slots 188 when the product dispenser is fully assembled.

Figure 4:
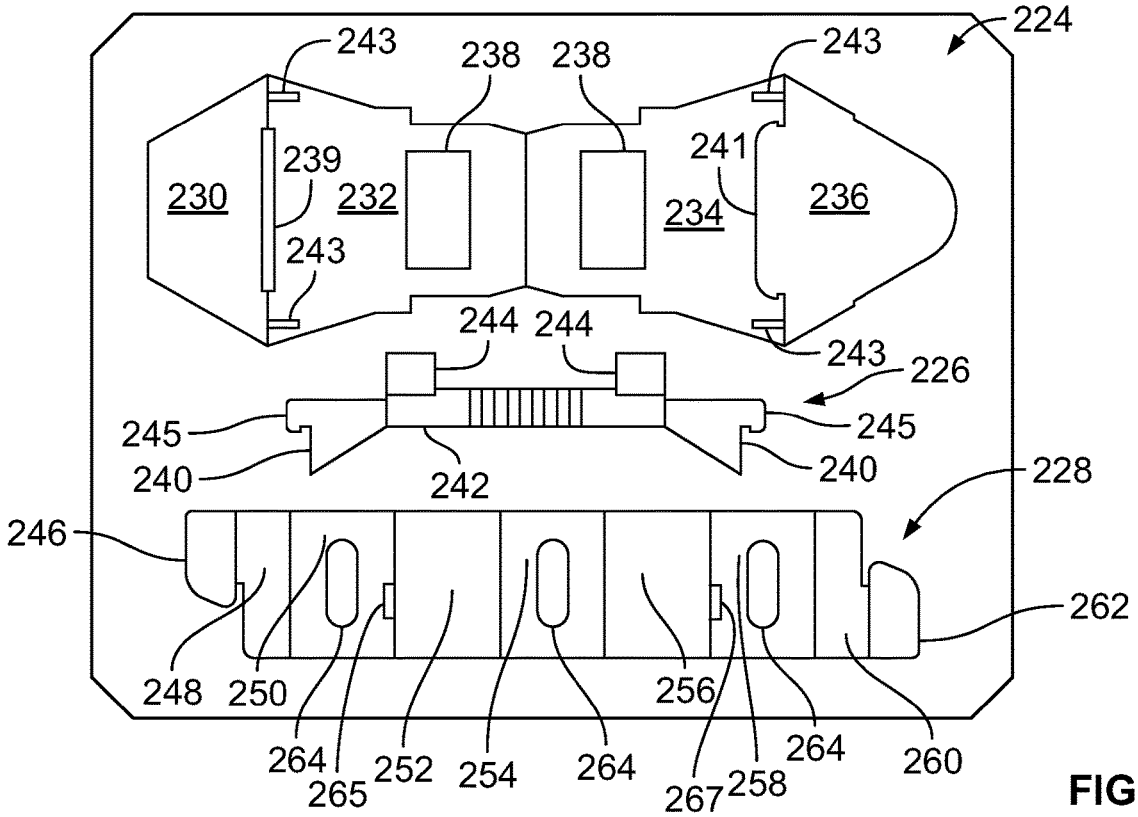
FIG. 4 illustrates ninth, tenth, and eleventh blanks of sheet material for forming the example product dispenser.
Figure 9:
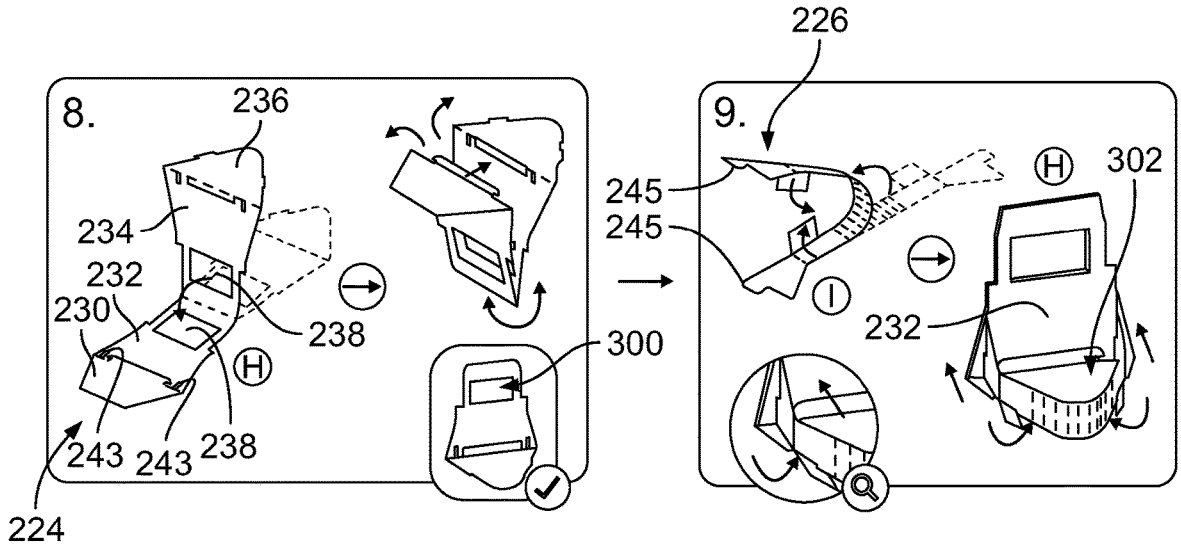
FIG. 9 illustrates a series of process steps for assembling part of an example base dispenser portion of the product dispenser from the ninth and tenth blanks of sheet material shown in FIG. 4.

FIG. 4 illustrates a ninth blank 224, a tenth blank 226, and an eleventh blank 228 of sheet material for forming the example product dispenser. In one example, ninth blank 224 includes a first panel 230, a second panel 232, a third panel 234, and a fourth panel 236. Each of second panel 232 and third panel 234 include a cutout which will serve as dispenser openings 238 as defined therein. In one example, a tab slot 239 is defined between panels 230 and 232, and a tab 241 is defined between panels 234 and 236. As shown in FIG. 9, ninth blank 224 is folded to position panels 232 and 234 in a face-to-face relationship, which enables tab 241 to be inserted within tab slot 239 for holding panels 232 and 234 in the face-to-face relationship. In addition, in one example, tab slots 243 are defined in panels 232 and 234, on opposing sides of tab slot 239 and tab 241. Tab slots 243 may be configured to receive tab 245 as shown and described below.

In one example, tenth blank 226 includes a pair of tapered side panels 240, a strap panel 242 extending therebetween, and a pair of base flaps 244 extending from strap panel 242. A tab 245 extends from each side panels 240. Strap panel 242 may have a series of lateral fold lines that facilitate bending of strap panel 242 and moving side panels 240 out of plane with each other. In one example, base flaps 244 may be wrapped around and coupled to an underside of central portion 198 (shown in FIG. 3) when assembling a base dispenser portion of the product dispenser. Coupling base flaps 244 to central portion 198 facilitates sealing strap panel 242 against central portion 198 for forming a receptacle in the base dispenser portion, as will be described in more detail below.

Figure 11:
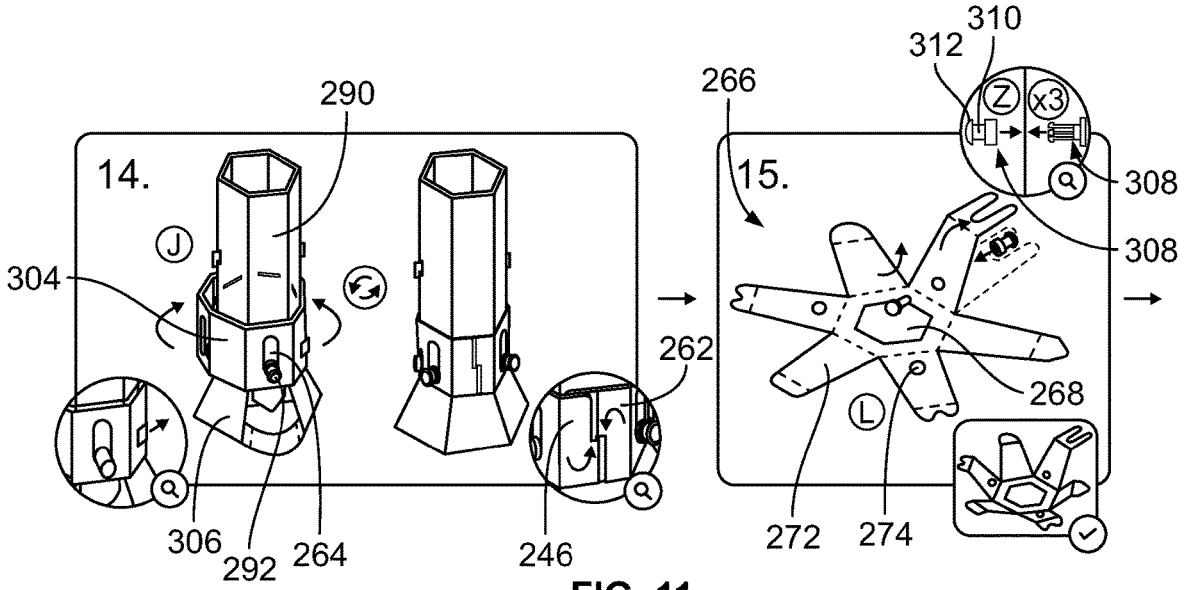
FIG. 11 illustrates a second series of process steps for assembling the example product dispenser from the parts shown in FIGS. 8 and 9, and from the sixth and eleventh blanks shown in FIGS. 3 and 4, and also shows process steps for forming a cover portion of the example product dispenser from the twelfth blank of sheet material shown in FIG. 5.

In one example, eleventh blank 228 includes a first joining flap 246, a first side panel 248, a second side panel 250, a third side panel 252, a fourth side panel 254, a fifth side panel 256, a sixth side panel 258, a seventh side panel 260, and a second joining flap 262. Each of second, fourth, and sixth side panels 250, 254, and 258 includes a translation slot 264 defined therein. In one example, a first tab slot 265 is defined between panels 250 and 252, and a second tab slot 267 is defined between panels 256 and 258. Translation slot 264 is configured to enable pins to extend therethrough when assembling a base dispenser portion, as illustrated in FIG. 10. Tab slots 265 and 267 are configured to receive tabs 204 when assembling the base dispenser portion, as illustrated in FIG. 11.

Figure 5:
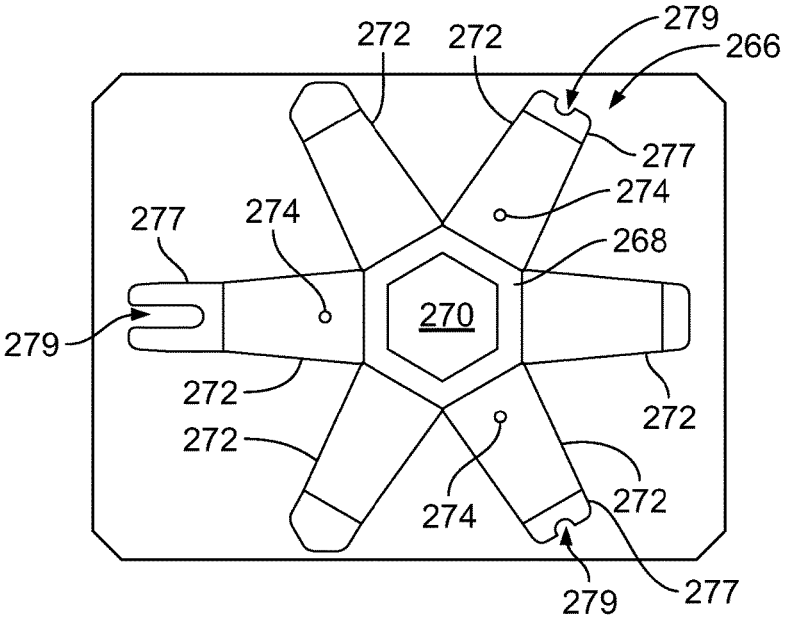
FIG. 5 illustrates a twelfth blank of sheet material for forming the example product dispenser.
Figure 12:
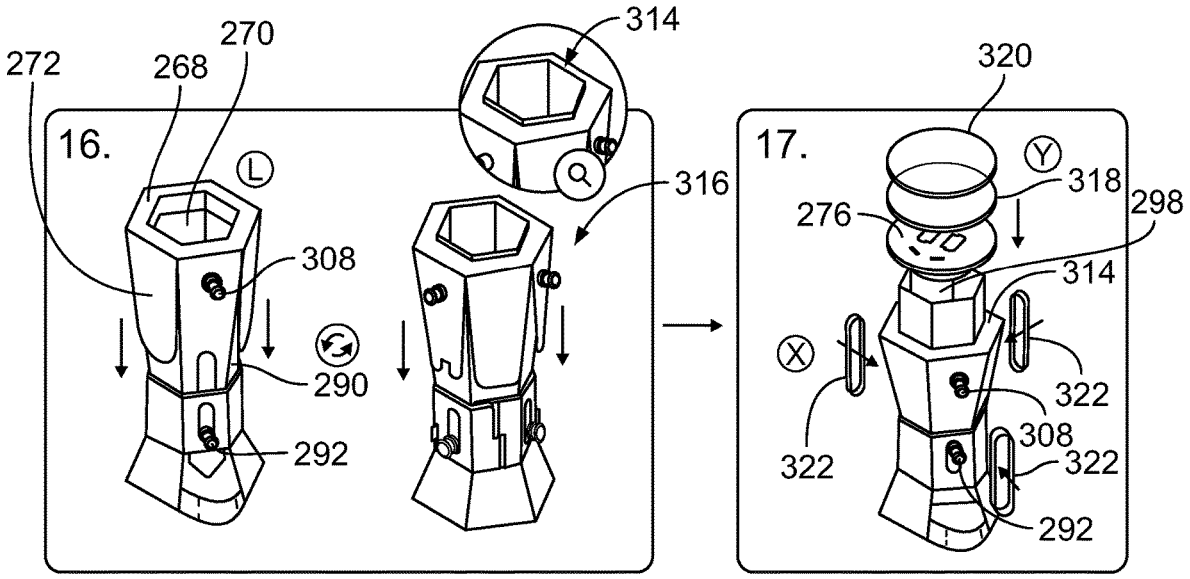
FIG. 12 illustrates a series of process steps for assembling the example product dispenser.

FIG. 5 illustrates a twelfth blank 266 of sheet material for forming the example product dispenser. In one example, twelfth blank 266 includes a central portion 268 having an access opening 270 defined therein. Access opening 270 is configured to receive product(s) when uncovered. Access opening 270 may be configured to receive the cover portion 276 (as described below) when in an assembled state. Central portion 268 has a generally polygonal shape and includes a plurality of side panels 272 extending from central portion 268 along respective fold lines. In one example, alternating side panels 272 each include a pin opening 274 defined therein. The respective side panels 272 having pin openings 274 defined therein also include distal flaps 277 each having a central slot 279 defined therein. Central slots 279 are configured to enable pins to extend therethrough when assembling a pin base portion, as illustrated in FIG. 12.

In one example, access opening 270 also has a generally polygonal shape that corresponds to central portion 268. Accordingly, access opening 270 and portions of central portion 268 that define access opening 270 are shaped to restrict rotational motion of cover portion 276 relative to central portion 268. For example, as shown in FIG. 6 below, when folded, cover portion 276 has a polygonal shape that corresponds to the shape of access opening 270 to restrict rotational movement of cover portion 276 relative to central portion 268.

Figure 6:
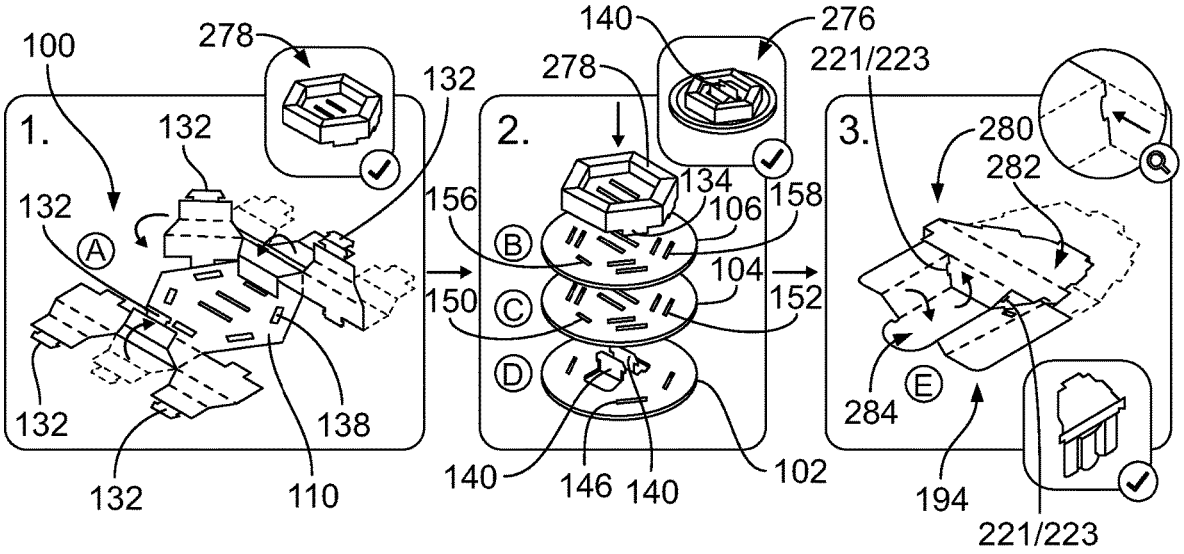
FIG. 6 illustrates a series of process steps for assembling an example cover portion of the product dispenser from the first, second, third, and fourth blanks of sheet material shown in FIG. 1.

FIG. 6 illustrates a series of process steps for assembling an example cover portion 276 of the product dispenser from the first, second, third, and fourth blanks 100, 102, 104, and 106 of sheet material shown in FIG. 1. In one example, as shown in Box 1, first blank 100 is folded to position first tabs 132 of each foldable flap 116, 118, 120, 124, 126, and 128 within respective peripheral tab slots 138 to define an insertion portion 278 of cover portion 276. In one example, as shown in Box 2, central joining tabs 140 are folded out of plane with the remainder of second blank 102, and insertion portion 278, second blank 102, third blank 104, and fourth blank 106 are aligned with each other to receive central joining tabs 140 therethrough. When oriented as such, peripheral tab slots 146, outer radial tab slots 152, and outer radial tab slots 158, as well as inner radial tab slots 150 and 156, are likewise aligned. First tabs 132 are insertable within inner radial tab slots 150 and 156, and second tabs 134 are insertable within peripheral tab slots 146, outer radial tab slots 152, and outer radial tab slots 158, to facilitate joining insertion portion 278 and blanks 102, 104, 106, thereby forming cover portion 276.

In one example, as shown in Box 3, seventh blank 194 is foldable to define a first ramp member 280 that includes a first ramp portion 282 and a storage slot 284. For example, side flaps of blank 194 are foldable out of plane to facilitate insertion of tab cutouts 221 within slots 223, thereby holding the side flaps in a raised position and facilitating formation of storage slot 284.

Figure 7:
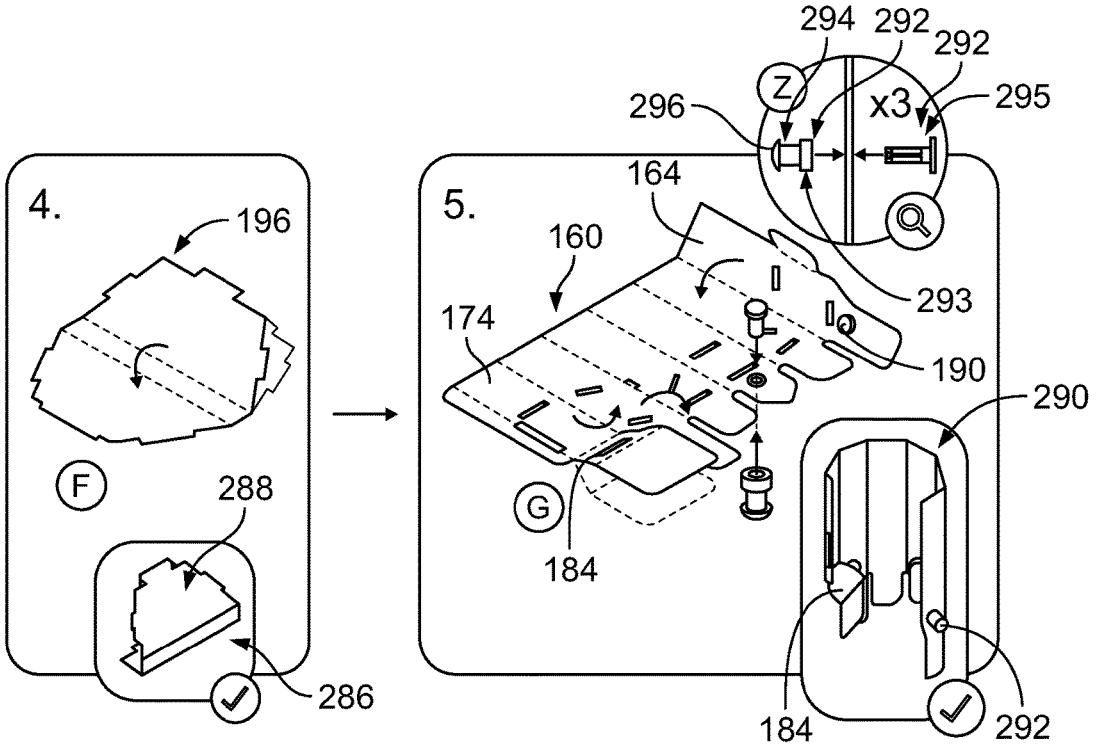
FIG. 7 illustrates a first series of process steps for assembling part of an example storage portion of the product dispenser from the fifth, seventh, and eight blanks of sheet material shown in FIGS. 2 and 3.

FIG. 7 illustrates a first series of process steps for assembling part of an example storage portion of the product dispenser from the fifth, seventh, and eight blanks 160, 194, and 196 of sheet material shown in FIGS. 2 and 3. In one example, as shown in Box 4, eighth blank 196 is foldable to define a second ramp member 286 including a second ramp portion 288. In one example, as shown in Box 5, fifth blank 160 is foldable to define a storage portion 290. Storage portion 290 includes blocking flap 184 folded out of plane with its respective side panel 174 and includes a pin 292 inserted within each pin opening 190. Pin 292 includes a first portion 293 and a second portion 295, which may be coupled to each other and assembled on respective panels. In one example, a shaft of second portion 295 is insertable through pin opening 190, and insertable within first portion 293, to facilitate assembling pin 292 on the panels. First portion 292 includes a notch 294, which defines a raised lip 296 for securely retaining an elastic member thereon, as will be described in more detail below.

Figure 8:
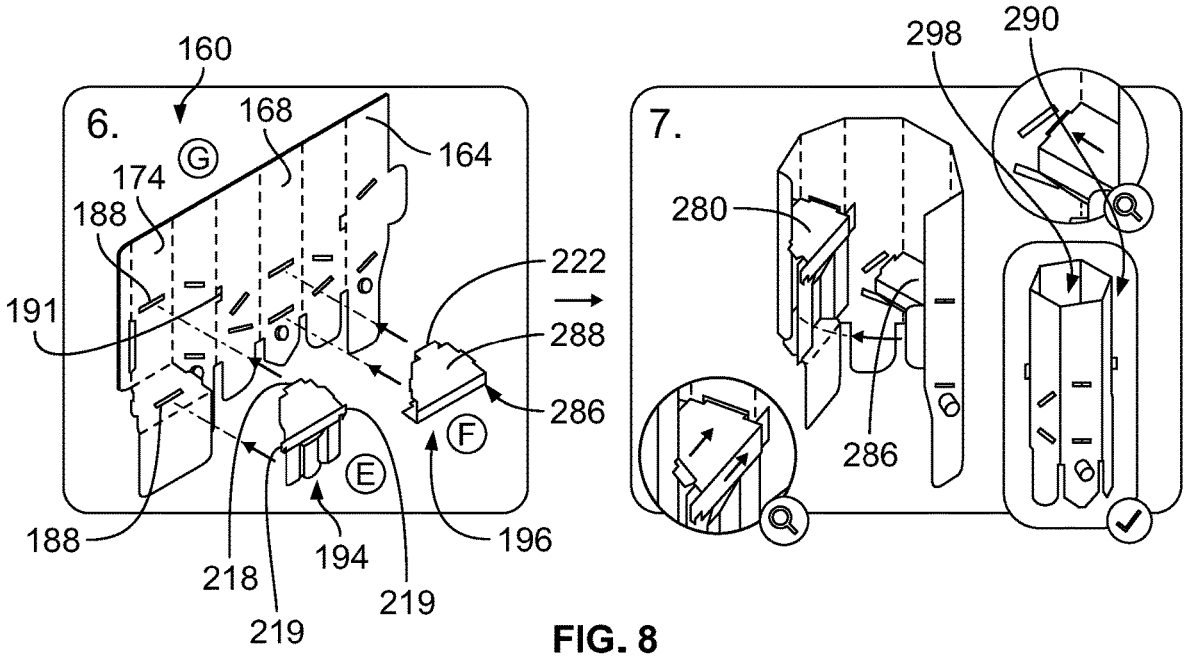
FIG. 8 illustrates a second series of process steps for assembling part of an example storage portion of the product dispenser from the fifth, seventh, and eight blanks of sheet material shown in FIGS. 2 and 3.

FIG. 8 illustrates a second series of process steps for assembling part of an example storage portion of the product dispenser from the fifth, seventh, and eighth blanks 160, 194, and 196 of sheet material shown in FIGS. 2 and 3. In one example, as shown in Boxes 6 and 7, first ramp member 280 and second ramp member 286 are coupled to storage portion 290 via tab/slot engagement. For example, tabs 219 are insertable within slots 191, and tabs 218 and 222 are insertable within slots 188, when storage portion 290 is fully assembled. Accordingly, first ramp portion 282 extends obliquely relative to side panel 174, and second ramp portion 288 extends obliquely relative to side panel 168. Thus, when side panels 164 and 174 are joined together to define an interior 298 of storage portion 290, first ramp member 280 and second ramp member 286 extend towards each other, and second ramp member 286 is positioned vertically below first ramp member 280. In an alternative example, first ramp member 280 and second ramp member 286 are coupled to storage portion 290 with adhesive, either in liquid form or tape form, or with a mechanical fastener.

FIG. 9 illustrates a series of process steps for assembling part of an example base dispenser portion of the product dispenser from the ninth and tenth blanks 224 and 226 of sheet material shown in FIG. 4. In one example, as shown in Box 8, ninth blank 224 is folded to position panels 232 and 234 in a face-to-face relationship, and such that panels 230 and 236 extend from opposing sides thereof. When in the face-to-face relationship, dispenser openings 238 are aligned to define a combined dispenser opening 300. In one example, as shown in Box 9, tenth blank 226 is folded to define an arcuate or semi-circular shape. Tenth blank 226 is then coupled to ninth blank 224 to define a receptacle 302 from third panel 234, fourth panel 236, tapered side panels 240, and strap panel 242. For example, tabs 245 are received within slots 243 to couple tenth blank 226 to ninth blank 224, which enables panels 240 to abut against panel 232 and enclose receptacle 302.

FIG. 10 illustrates a first series of process steps for assembling the example product dispenser from the parts shown in FIGS. 8 and 9, and from the sixth and eleventh blanks 192 and 228 of sheet material shown in FIGS. 3 and 4. In one example, as shown in Box 10, storage portion 290 is coupled to the part assembled in Box 9. For example, when storage portion 290 is assembled, a slot 291 is defined between adjacent bottom panels 180. Panels 232 and 234 of blank 224 are received within respective slots 291, such as with an interference fit, when storage portion 290 is coupled to the part assembled in Box 9. Accordingly, bottom panels 180 defining slots 291 abut against panels 232 and 234 to facilitate holding storage portion 290 onto the part assembled in Box 9. In one example, as shown in Box 11, eleventh blank 228 is folded to define a circumferential strap 304. In one example, as shown in Box 12, side flaps 200 of sixth blank 192 are folded out of plane with central portion 198. In one example, as shown in Box 13, central portion 198 of sixth blank 192 is positioned underneath the part assembled in Box 9, and side flaps 200 are folded towards storage portion 290. Sixth blank 192 is oriented relative such that each central slot 206 is aligned with a respective pin 292 when side flaps 200 are folded towards storage portion 290.

Side flaps 200 are secured to each other, but not to storage portion 290, via tab/notch engagement between respective side flaps 200 to define a base dispenser portion 306. As such, as will be explained in more detail below, storage portion 290 is translatable relative to base dispenser portion 306.

FIG. 11 illustrates a second series of process steps for assembling the example product dispenser from the parts shown in FIGS. 8 and 9, and from the sixth and eleventh blanks shown in FIGS. 3 and 4, and also shows process steps for forming a pin base portion of the example product dispenser from the twelfth blank of sheet material shown in FIG. 5. In one example, as shown in Box 14, circumferential strap 304 is folded around storage portion 290 and base dispenser portion 306 to facilitate securing the two parts together. Circumferential strap 304 is coupled thereto via engagement between joining flaps 246 and 262. In addition, circumferential strap 304 is oriented relative to storage portion 290 such that translation slots 264 are aligned with a respective pin 292 on storage portion 290. Accordingly, each pin 292 is inserted through a respective translation slot 264, and a range of motion of pins 292, as storage portion 290 is translated relative to base dispenser portion 306, is limited by first and second ends of translation slots 264. In one example, as shown in Box 15, side panels 272 of twelfth blank 266 are foldable out of plane with central portion 268, and a pin 308 is inserted within each pin opening 274. Each pin 308 includes a notch 310, which defines a raised lip 312 for securely retaining an elastic member thereon, as will be described in more detail below.

FIG. 12 illustrates a series of process steps for assembling the example product dispenser. In one example, as shown in Box 16, central portion 268 of twelfth blank 266 is aligned with a top end 314 of storage portion 290, and top end 314 is insertable through access opening 270 when twelfth blank 266 is assembled onto storage portion 290. Side panels 272 are folded against the side panels of storage portion 290 to define a pin base portion 316. In addition, twelfth blank 266 is oriented relative to storage portion 290 such that each pin 308 is vertically aligned with a respective pin 292 of storage portion 290. When assembled onto storage portion 290, pin base portion 316 is in a fixed position relative to base dispenser portion 306.

In one example, as shown in Box 17, cover portion 276 is removably assembled onto top end 314 of storage portion 290 to facilitate restricting access to interior 298. A cover panel 318 and a dome member 320 may be assembled onto cover portion 276 to facilitate enhancing the aesthetic appearance of the product dispenser. For example, cover panel 318 may have decorative graphics printed thereon, and dome member 320 facilitates providing cover portion 276 with the appearance of push button designed for interaction with the consumer. In one example, dome member 320 is transparent. Also shown in Box 17, a plurality of elastic members 322 are coupled between respective pairs of pins 292 and 308. Example elastic members 322 include, but are not limited to, rubber bands, elastomers, and the like.

Figure 13:
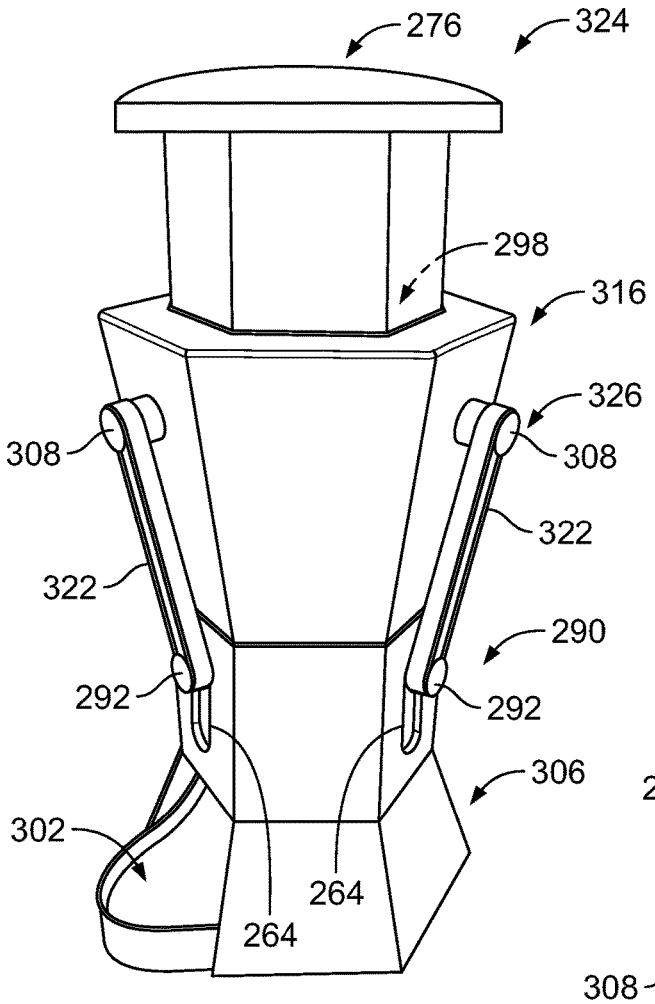
FIG. 13 is a perspective view of the example product dispenser in a first operational position.

FIG. 13 is a perspective view of the example product dispenser 324 in a first operational position. In the example embodiment, product dispenser 324 includes base dispenser portion 306, storage portion 290, pin base portion 316, an actuating mechanism 326 (e.g., elastic members 322 (shown in FIG. 12)), and cover portion 276. In one example, cover portion 276 is removable from storage portion 290 to provide access to interior 298 thereof, such as to add a quantity of products (not shown) to interior 298. Cover portion 276 may then be reassembled onto storage portion 290 when a desired quantity of products has been added to storage portion 290.

As noted above, storage portion 290 is translatable relative base dispenser portion 306, and pin base portion 316 is in a fixed position relative to base dispenser portion 306. Thus, pins 292 of base dispenser portion 306 are translatable relative to base dispenser portion 306, and pins 308 of pin base portion 316 are in a fixed position relative to base dispenser portion 306. Pins 308 are positioned vertically above pins 292 and, in the example embodiment, elastic members 322 are sized to be tensioned when coupled between pins 292 and 308. Accordingly, elastic members 322 facilitate translating pins 292 towards pins 308, and thus raising storage portion 290 vertically, when elastic members 322 are in a first tensioned state, thereby defining the first operational position. In one example, translation slots 264 facilitate limiting the vertical translational movement of storage portion 290 relative to base dispenser portion 306.

Figure 14:
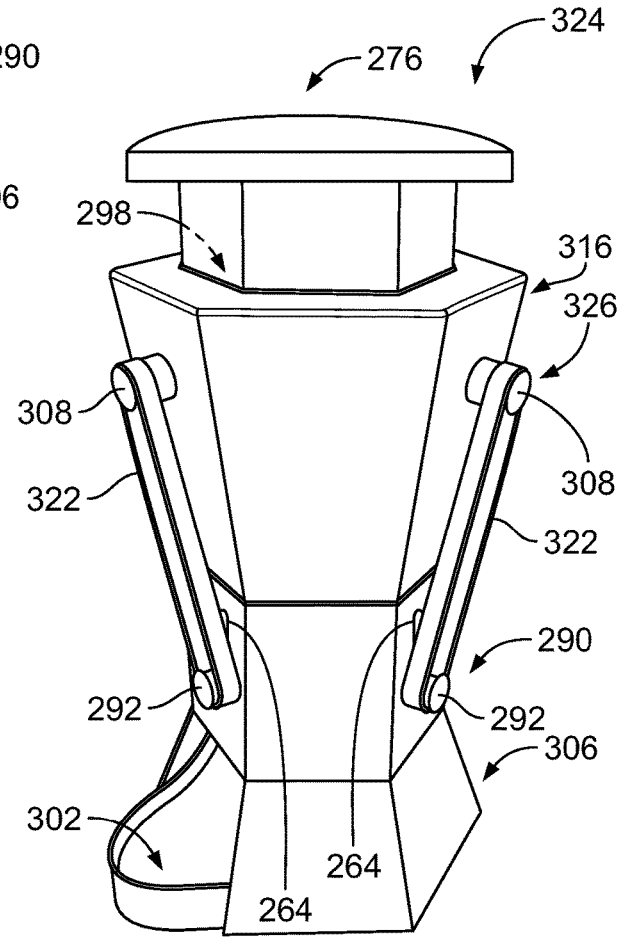
FIG. 14 is a perspective view of the example product dispenser in a second operational position.

FIG. 14 is a perspective view of the example product dispenser 324 in a second operational position. When in the first tensioned state, elastic members provide a first biasing force against pins 292. A second biasing force may be provided to storage portion 290 such as by pressing on cover portion 276. When the second biasing force is greater than the first biasing force, storage portion 290 translates vertically downward to position product dispenser 324 in the second operational position.

In one example, when product dispenser 324 is in the first operational position, blocking flap 184 (shown in FIG. 8) covers combined dispenser opening 300 (shown in FIG. 9) to restrict dispensation of products through combined dispenser opening 300 from interior 298. When product dispenser 324 is in the second operational position, blocking flap 184 is translated vertically downward and is moved out of alignment with combined dispenser opening 300. As shown in FIG. 8, storage slot 284 is positioned directly vertically above blocking flap 184. Accordingly, translating storage portion 290 vertically downward facilitate moving storage slot 284 into alignment with combined dispenser opening 300, thereby enabling products contained therein to be dispensed through combined dispenser opening 300 and received within receptacle 302. When in the second operational position, first ramp member 280 (shown in FIG. 8) may be aligned with and abutted against a top portion of folded ninth blank 224. Accordingly, in one example, additional products, other than those contained within storage slot 284, may be restricted from being dispensed through combined dispenser opening 300.

Figure 15:
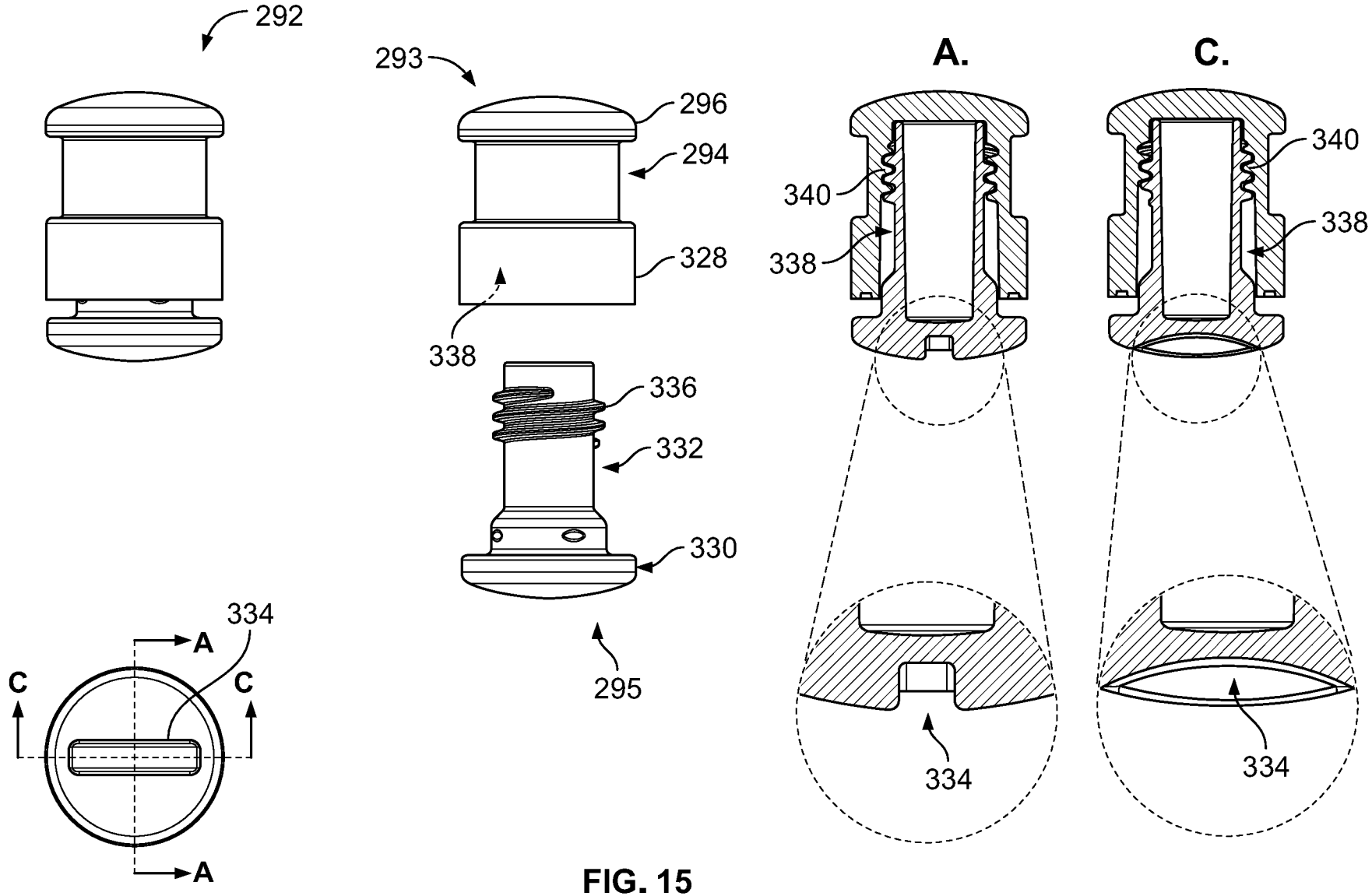
FIG. 15 illustrates various views of an example pin that may be coupled between the elastic members shown in FIGS. 13 and 14.

FIG. 15 illustrates various views of an example pin 292 that may be coupled between the elastic members shown in FIGS. 13 and 14. In one example, pin 292 includes a first portion 293 and a second portion 295, which may be coupled to each other and assembled on respective panels. First portion 293 includes a base end 328, raised lip 296, and notch 294 defined therebetween. Second portion 295 includes a head portion 330 and a shaft portion 332. Head portion 330 includes a driving slot 334 defined therein for receiving a tool head and enabling rotation of second portion 295 relative to first portion 293. Shaft portion 332 includes a threaded member 336 formed thereon. First portion 293 includes an interior 338 at least partially defined by a threaded side wall 340. Accordingly, second portion 295 is threadably engageable with first portion 293 to assemble pin 292 on respective panels.

The dispenser may be configured to receive a number of different products and it may receive more than one type of product at a time.

In one example, an unassembled dispenser, products, and instructions are sold as one kit in, for example, a retail establishment or shipped directly from the manufacturer.

This written description uses examples to disclose various implementations, including the best mode, and to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A product dispenser formed from a plurality of blanks of sheet material, the product dispenser comprising:

a storage portion formed from at least one folded blank of sheet material, the storage portion comprising an interior configured to hold a quantity of products therein;

a base dispenser portion formed from at least one folded blank of sheet material, wherein the base dispenser portion is coupled to the storage portion, and wherein the base dispenser portion comprises a receptacle in selective communication with the interior;

a pin base portion formed from at least one blank of sheet material, the pin base portion configured to couple to the storage portion and be in a fixed position relative to the base dispenser portion and the storage portion, and the at least one blank of the pin base portion including a plurality of side panels configured to be folded against a plurality of side panels of the storage portion, and an actuating mechanism comprising:

a first pin including a notch and a raised lip, the first pin coupled to the storage portion; and a second pin coupled to the pin base portion, wherein an elastic member is configured to couple to the first pin and the second pin, wherein the elastic member is disposed on the notch, and wherein the elastic member is retained on the notch by the raised lip;

wherein the actuating mechanism is configured to translate the storage portion relative to the base dispenser portion and the pin base portion, wherein the products are restricted by the elastic member from being dispensed to the receptacle when the storage portion is in a first operating position, and the products are dispensable to the receptacle when the storage portion is in a second operating position, wherein actuation of the actuating mechanism transitions the storage portion between the first operating position and the second operating position, and wherein the elastic member comprises a rubber band.

2. The product dispenser in accordance with claim 1, wherein the folded blanks of sheet material are fabricated from a paperboard or cardboard material.

3. The product dispenser in accordance with claim 1, wherein the storage portion is configured to receive a comestible product.

4. The product dispenser in accordance with claim 1, further comprising a cover portion formed from at least one blank of sheet material, the cover portion removably coupled to the storage portion for providing access to the interior.

5. The product dispenser in accordance with claim 1, wherein the sheet material is recyclable.

6. A kit for forming a product dispenser for dispensing products, the kit comprising:

at least one blank of sheet material for forming a storage portion of the product dispenser, wherein the at least one blank is foldable for forming an interior configured to hold a quantity of products therein;

at least one blank of sheet material for forming a base dispenser portion of the product dispenser, the base dispenser portion configured to couple to the storage portion, wherein the at least one blank of the base dispenser portion is foldable for forming a receptacle in selective communication with the interior;

an actuating mechanism configured to translate the storage portion relative to the base dispenser portion and a pin base portion; and at least one blank of sheet material for forming the pin base portion of the product dispenser, the pin base portion configured to couple to the storage portion and be in a fixed position relative to the base dispenser portion and the storage portion, and the at least one blank of the pin base portion including a plurality of side panels configured to be folded against a plurality of side panels of the storage portion, wherein the actuating mechanism includes:

a plurality of pins comprising a first pin configured for coupling to the storage portion, and translation relative to, the at least one blank of the base dispenser portion and the pin based portion, and a second pin configured for coupling to the at least one blank of the pin base portion, the second pin being vertically aligned with the first pin when the second pin is coupled to the at least one blank of the pin base portion; and an elastic member configured to couple the first pin and the second pin, to be in tension when coupling the first pin and the second pin, and to facilitate translation of the first pin toward the second pin, to thereby cause the storage portion to translate relative to the base dispenser portion and the pin base portion.

7. The kit in accordance with claim 6, wherein the at least one of the blanks of sheet material for forming the storage portion, the base dispenser portion, or the pin base portion has a graphic printed thereon or included on a label applied thereto.

8. The kit in accordance with claim 6, wherein the at least one of the blanks of sheet material for forming the storage portion and the base dispenser portion are packaged in a flat state.

9. The kit in accordance with claim 6, further comprising an instruction manual for assembling the product dispenser or instructions for assembling the kit.

10. The kit in accordance with claim 6, wherein the sheet material is recyclable.

11. The kit in accordance with claim 6, further comprising a comestible product.

12. The kit in accordance with claim 6, wherein the folded blanks of sheet material are fabricated from a paperboard or cardboard material.

13. The kit in accordance with claim 6, wherein the sheet material is recyclable.

14. A product dispenser formed from a plurality of blanks of sheet material, the product dispenser comprising:

a storage portion formed from at least one folded blank of sheet material, the storage portion comprising an interior configured to hold a quantity of products therein;

a base dispenser portion formed from at least one folded blank of sheet material, wherein the base dispenser portion is coupled to the storage portion, and wherein the base dispenser portion comprises a receptacle in selective communication with the interior;

an actuating mechanism configured to translate the storage portion relative to the base dispenser portion and a pin base portion, wherein the products are restricted from being dispensed to the receptacle when the storage portion is in a first operating position, and the products are dispensable to the receptacle when the storage portion is in a second operating position; and the pin base portion formed from at least one folded blank of sheet material, wherein the pin base portion is coupled to the storage portion and is in a fixed position relative to the base dispenser portion and the storage portion, the pin base portion including a plurality of side panels folded against a plurality of side panels of the storage portion, wherein the actuating mechanism includes:

a plurality of pins comprising a first pin configured for coupling to the storage portion, and translation relative to, the at least one blank of the base dispenser portion and the pin base portion, and a second pin configured for coupling to the at least one blank of the pin base portion, the second pin being vertically aligned with the first pin when the second pin is coupled to the at least one blank of the pin base portion; and an elastic member configured to couple the first pin and the second pin, to be in tension when coupling the first pin and the second pin, and to facilitate translation of the first pin toward the second pin, to thereby cause the storage portion to translate relative to the base dispenser portion and the pin base portion.

15. The product dispenser in accordance with claim 14, wherein the actuating mechanism is coupled to the base dispenser portion and the pin base portion.

16. The product dispenser in accordance with claim 14, wherein the at least one folded blank of sheet material is fabricated from a paperboard or cardboard material.

17. The product dispenser in accordance with claim 14, wherein the storage portion is configured to receive a comestible product.

18. The product dispenser in accordance with claim 14, further comprising a cover portion formed from at least one blank of sheet material, the cover portion removably coupled to the storage portion for providing access to the interior.

19. The product dispenser in accordance with claim 14, further comprising at least one blank of sheet material for forming the pin base portion of the product dispenser, the pin base portion configured to couple to the storage portion.

20. The product dispenser in accordance with claim 14, wherein at least one of the blanks of sheet material for forming the storage portion, the base dispenser portion, or the pin base portion has a graphic printed thereon or included on a label applied thereto.

* * * * *